US010039382B2

(12) United States Patent
Dickey

(10) Patent No.: US 10,039,382 B2
(45) Date of Patent: Aug. 7, 2018

(54) STOOL SEAT

(71) Applicant: Sico Incorporated, Edina, MN (US)

(72) Inventor: Christopher C Dickey, West St. Paul, MN (US)

(73) Assignee: Sico Incorporated, Edina, MN (US)

( * ) Notice: Subject to any disclaimer, the term of this patent is extended or adjusted under 35 U.S.C. 154(b) by 0 days.

(21) Appl. No.: 15/099,296

(22) Filed: Apr. 14, 2016

(65) Prior Publication Data

US 2016/0302576 A1 Oct. 20, 2016

Related U.S. Application Data

(60) Provisional application No. 62/148,601, filed on Apr. 16, 2015.

(51) Int. Cl.

| | |
|---|---|
| ***A47B 83/02*** | (2006.01) |
| ***A47C 7/00*** | (2006.01) |
| ***A47C 7/16*** | (2006.01) |

(52) U.S. Cl.

CPC ..... *A47B 83/02* (2013.01); *A47C 7/16* (2013.01)

(58) Field of Classification Search

CPC ..... A47C 7/16; A47B 83/02

USPC ... 297/157.1–159.1, 440.15, 440.16, 452.21, 297/195.11, 239, 451.11, 451.12, 452.23, 297/440.22

See application file for complete search history.

(56) References Cited

U.S. PATENT DOCUMENTS

D194,038 S * 11/1962 Enos ..... D6/337
3,075,809 A * 1/1963 Wilson ..... A47B 3/14 108/173
3,109,678 A * 11/1963 Wilson ..... A47B 3/14 108/155
3,127,221 A * 3/1964 Bennett, Jr. ..... A47C 3/12 297/452.14
D211,886 S * 8/1968 Benjamin ..... D6/337
3,511,532 A * 5/1970 Tringali ..... A47B 3/14 108/173
3,637,256 A * 1/1972 Harty ..... A47C 1/124 297/239
3,715,143 A * 2/1973 Gerken ..... A47B 3/14 108/173
3,982,785 A * 9/1976 Ambasz ..... A47C 1/023 297/239 X
4,052,100 A * 10/1977 Nikitits ..... A47B 3/14 297/158.4 X (Continued)

*Primary Examiner* — Rodney B White

(74) *Attorney, Agent, or Firm* — Merchant & Gould P.C.

(57) ABSTRACT

A table and seating system includes a folding table. A folding framework supports the table section and has vertical frame elements supporting stool type seats. The stool type seats each have a monolithic seat element. The seat element has a substantially rectangular periphery including opposed end portions and opposed side portions with rounded corner portions abutting the end portions and the side portions. The upper surface of the seat has a concave upper surface with a center portion lower than the end portions, but does not form a depression capable of pooling liquids. A center receiving portion projects from an underside of the seat portion with the vertical frame element inserting into the center receiving portion. Radial ribs on an underside of the seat extend from the center receiving portion to a periphery of the seat portion and intersect a circular rib and a rectangular rib.

21 Claims, 6 Drawing Sheets

(56) References Cited

U.S. PATENT DOCUMENTS

D268,971 S 5/1983 Reineman
4,569,555 A * 2/1986 Lehman ..... A47B 83/02 108/159
4,998,774 A * 3/1991 Huff ..... A47C 9/007 297/452.41
5,002,337 A * 3/1991 Engel ..... A47C 1/124 297/239 X
5,112,103 A * 5/1992 Downer ..... A47C 3/029 297/188.12
5,439,269 A * 8/1995 Cheng ..... A47C 4/02 108/150
5,921,622 A * 7/1999 Newton ..... A47B 83/02 297/157.1
D413,734 S * 9/1999 Bue ..... D6/337
6,065,802 A 5/2000 Bue
6,074,005 A * 6/2000 Simmons ..... A47C 1/12 108/150
6,116,681 A * 9/2000 Borglum ..... A47B 37/00 297/157.1
6,186,591 B1 * 2/2001 Pajerski ..... A47B 3/14 108/125
D439,060 S * 3/2001 Larsen ..... D6/337
6,254,178 B1 7/2001 Bue
6,319,585 B1 * 11/2001 Coronado ..... A47C 5/14 144/381
D456,155 S 4/2002 DeVriendt
6,386,628 B2 5/2002 Bue
D478,732 S * 8/2003 Pajerski ..... D6/337
D479,406 S * 9/2003 Pajerski ..... D6/337
D479,773 S 9/2003 Pajerski et al.
6,908,159 B2 * 6/2005 Prince ..... A47C 1/023 297/452.23 X
7,017,986 B2 * 3/2006 Degen ..... A47C 4/20 297/451.11 X
7,234,780 B2 * 6/2007 Lipniarski ..... A47C 5/12 297/423.1
7,393,049 B2 7/2008 Chase
7,549,702 B2 * 6/2009 Meyers ..... A47K 3/122 297/452.23 X
D595,969 S 7/2009 Hanusiak
7,611,193 B2 11/2009 Bue et al.
7,758,113 B2 7/2010 Hanusiak
8,182,032 B2 5/2012 Dickey et al.
8,544,943 B2 * 10/2013 Fields ..... A47C 1/11 297/195.11 X
D702,979 S 4/2014 Jannetides
D703,474 S 4/2014 Bradley
8,820,826 B2 9/2014 Dickey
9,101,218 B2 8/2015 Bradley
D763,029 S * 8/2016 Dickey ..... D6/708.17
9,759,248 B1 * 9/2017 Wu ..... A47C 5/043
2003/0209925 A1 * 11/2003 Bosman ..... A47B 7/02 297/239
2005/0116513 A1 * 6/2005 Ashby ..... A47B 83/02 297/158.4
2010/0156155 A1 * 6/2010 Smith ..... A47C 1/124 297/239
2010/0156156 A1 * 6/2010 Smith ..... A47C 1/124 297/239
2014/0145480 A1 * 5/2014 Johnson ..... A47C 3/04 297/239
2016/0058193 A1 * 3/2016 Bellingar ..... A47C 7/50 297/452.21

* cited by examiner

STOOL SEAT

BACKGROUND OF THE INVENTION

Field of the Invention

The present invention is directed to a molded stool seat and in particular to a substantially rectangular stool seat having a curved upper surface.

Description of the Prior Art

In large, multi-purpose rooms and spaces that are utilized at various times as dining rooms, meeting spaces, dance areas, training rooms, classrooms and other varied activities, it is often desirable that mobile, multi-purpose furniture be utilized. Such furniture includes tables, chairs, benches and/or stools as well as table and seat combinations. Moreover, where practical, such furniture may be folded to occupy less space for storage when not in use. Table and seating combinations often utilize stool type seats that provide great utility and access for those using the table and seating system. Such seats provide access without having to step over bench type seating systems. Such systems may be foldable and may be mounted on casters or wheels for transport to and from storage.

Heretofore, many table and seating systems utilize stool type seating with round seating elements. The seating elements typically mount on a center framework. The elements are typically lightweight molded plastic seats that mount to a vertical tubular support post. These seats may be bolted to the seat support with a conventional bolt. Moreover, systems have been developed to minimize damage from abuse and prevent rotation of the seat portion relative to the tubular support post.

Although such stool type seats have proven to be useful, these seats do have some shortcomings. The typical stool seat is a round seat with a center portion that is concave. Although such round seats with a concave upper surface may be more comfortable for a user than a planar upper surface, the round seats do not provide a comfortable contour for many users. Moreover, although such round seats may be comfortable for a user sitting on the stool for only a short period of time, such as during a school lunch, a user may not find these same seats comfortable during more extended uses. In addition, the concave upper surface does not shed fluids should a spill occur. Therefore, spilled fluids will pool in the center of many types of circular stools and may be more difficult to clean and or cause discomfort for a user.

It can be seen that a new and improved lightweight molded stool seat is needed. Such a seat should provide for being lightweight, easily molded, durable and mounting to a center vertical tubular frame. Moreover, such a seat should provide enhanced comfort for a user, even when sitting for extended periods of time. Such a system should also have an upper surface that prevents pooling of spilled fluids from occurring. The present invention addresses these as well as other problems associated with stool type seating.

SUMMARY OF THE INVENTION

The present invention is directed to a seating system and in particular to a seating system having non-circular stool type seats. The seat may be utilized with a table and seating apparatus including a table and a frame supporting the table. The frame includes a vertical frame element configured at the top end for supporting one or more seats.

The seat includes an upper surface having a substantially rectangular periphery. The seat includes opposed raised end portions and opposed side portions. The seat includes rounded corner portions abutting the end portions of the side portions. The upper surface of the seat is concave with the center portion lower than the end portions, but the edges at the side portions allow fluids to run off and therefore prevent pooling.

An underside of the seat includes a center frame receiving portion directed downward from the center of the seat. The center receiving portion includes a cavity configured for receiving the vertical frame element of the frame. The cavity may include a round cross section and a portion with a non-circular cross section configured for receiving a complementary frame member having at least a portion with a non-circular cross section to prevent relative rotation between the frame and the seat.

The underside of the seat also includes radial ribs extending from the center frame receiving portion outward to a lip at the periphery of the seat. The height of the radial ribs generally increases from the lip at the periphery of the seat to the bottom of the frame receiving portion at the center of the underside of the seat. The underside of the seat may also include a rectangular rib spaced inward from the lip and outward from the frame receiving portion. The rectangular rib intersects the radial ribs and provides added support. Spaced inward from the rectangular rib but spaced outward from the frame receiving portion is a circular rib. The circular rib also intersects the radial ribs and extends downward further than the rectangular rib. The configuration of the ribs and the seat provides for a seat element that is strong and lightweight and molded out of conventional materials.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference letters and numerals indicate corresponding structure throughout the several views.

DETAILED DESCRIPTION OF THE PREFERRED EMBODIMENT

Figure 1:
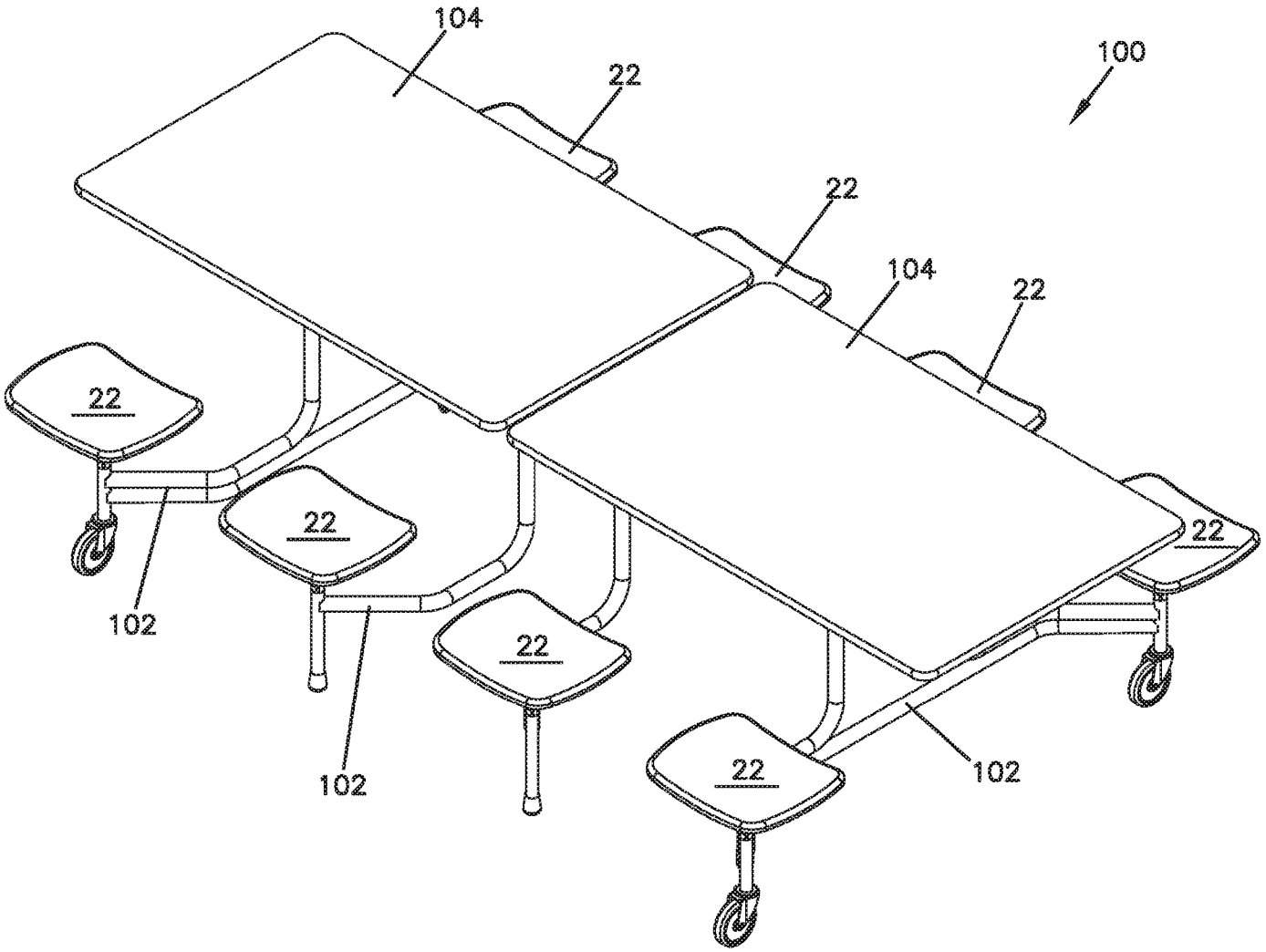
FIG. 1 is a perspective view of a table and seating apparatus according to the principles of the present invention.

Referring now to the drawings, and in particular to FIG. 1, there is shown a table and seating apparatus generally designated (100). The table and seating apparatus (100) includes a pair of table tops (104) supported by a framework (102). The framework (102) has tubular frame members having a generally round cross-section that are joined together by welding or other conventional techniques. In the embodiment shown, the table and seating apparatus (100) is a folding system and includes a center folding linkage that provides for folding between a storage position (not shown) wherein the table tops substantially oppose one another and in the extended position for use. It can be appreciated that the present invention may be utilized with other table and seating arrangements, including those that are not foldable. Moreover, the present invention may also be utilized with seating systems that do not include a table.

Figure 2:
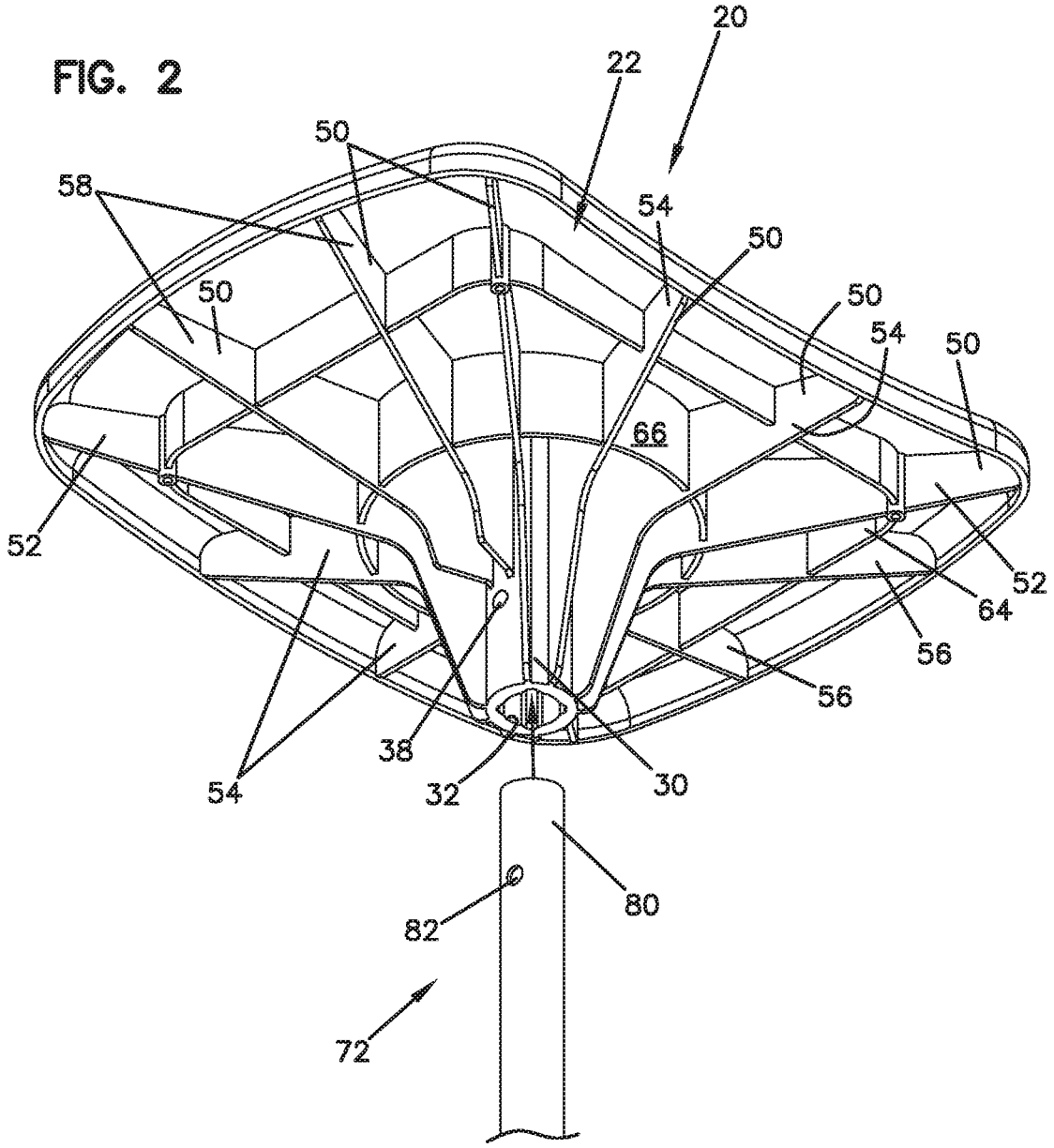
FIG. 2 is a partially exploded bottom perspective view of a first embodiment of a seat assembly for the table and seating apparatus shown in FIG. 1.
Figure 3:
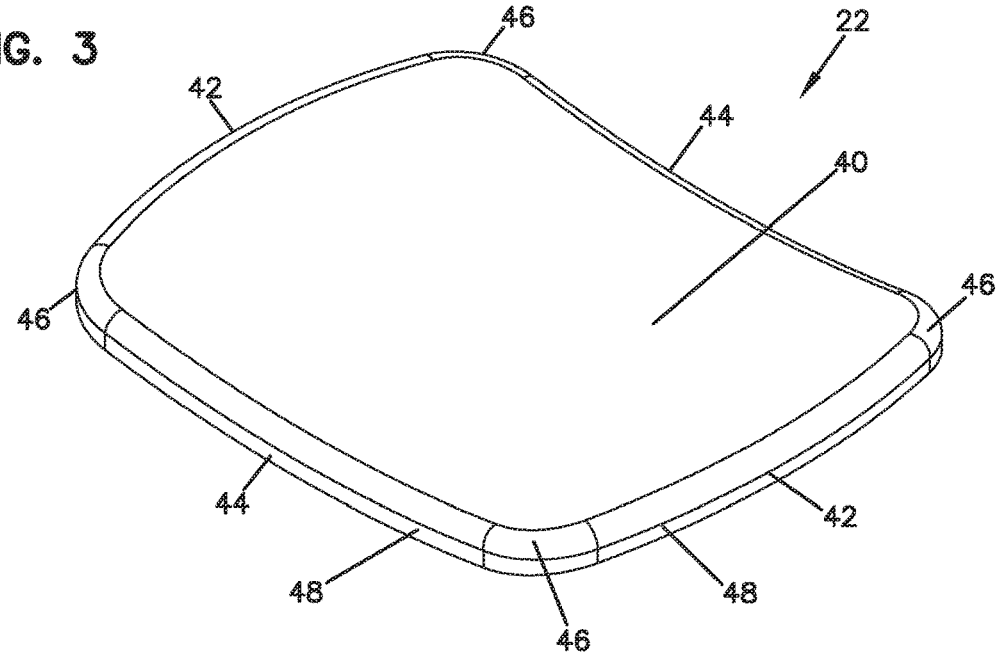
FIG. 3 is a top perspective view of a seat element for the table and seating apparatus shown in FIG. 1.
Figure 4:
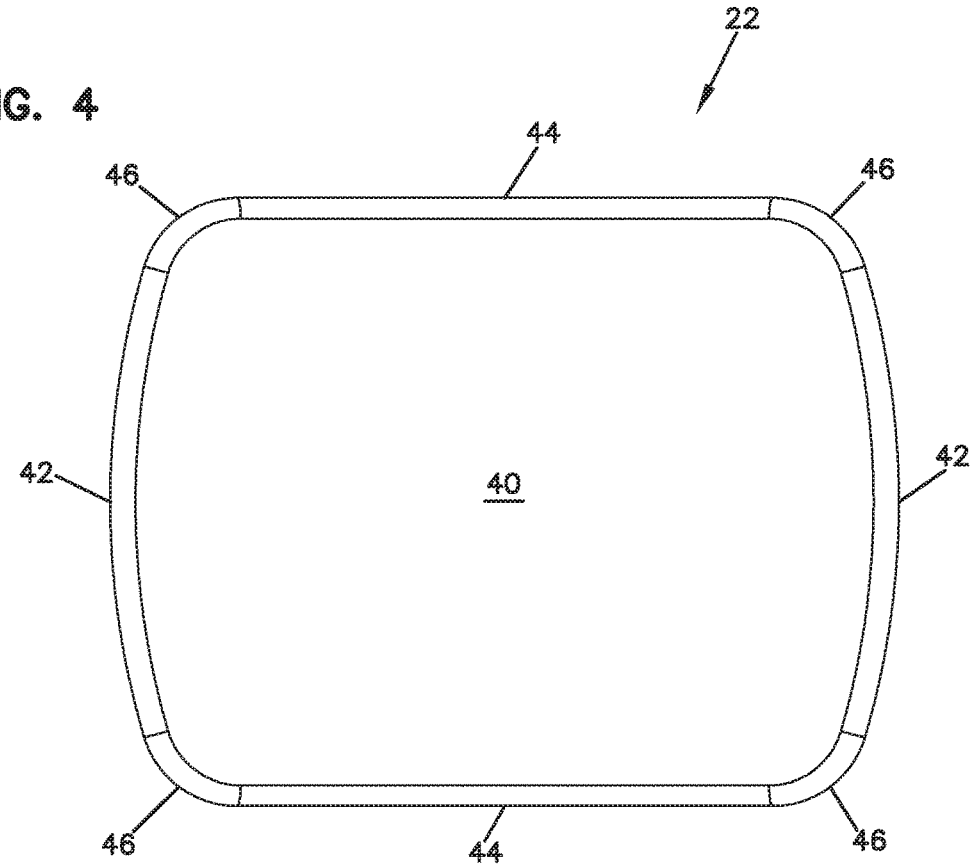
FIG. 4 is a top plan view of the seat element shown in FIG. 3.

The table and seating system includes seat assembly (20) including seats (22), as shown more clearly in FIG. 2. As shown in FIGS. 3 and 4, the seat element (22) has a generally rectangular shape with an upper surface (40) that is concave relative to raised ends (42). The seat element (22) is preferably a monolithic molded plastic element that may be molded out of any suitable lightweight plastic material. The seat element (22) has the ends (42) raised between opposed sides (44) and rounded corners (46). A lip (48) generally extends around the periphery of the seat element and projects downward. The transition from the lip (48) to the upper surface (40) is generally rounded with no sharp edges. In the embodiment shown, the length between the opposed ends (42) is greater than the width between the opposed sides (44). However, it can be appreciated that the relative dimensions may be varied while still falling within the spirit and scope of the present invention. Moreover, the concave upper surface may have a greater or lesser curvature depending on the application and intended users. The sides are generally shown as being straight and the ends having a slight curvature but as long as the seat (22) generally maintains a rectangular shape, the substantial straightness with a slight arc may be varied as long as it can be easily molded. However, it is preferred that the upper surface (40) is free of a depression that may pool fluids if spilled. It has been found that concavity between the ends (42) with the somewhat rectangular shape provides satisfactory comfort for a user.

Figure 5:
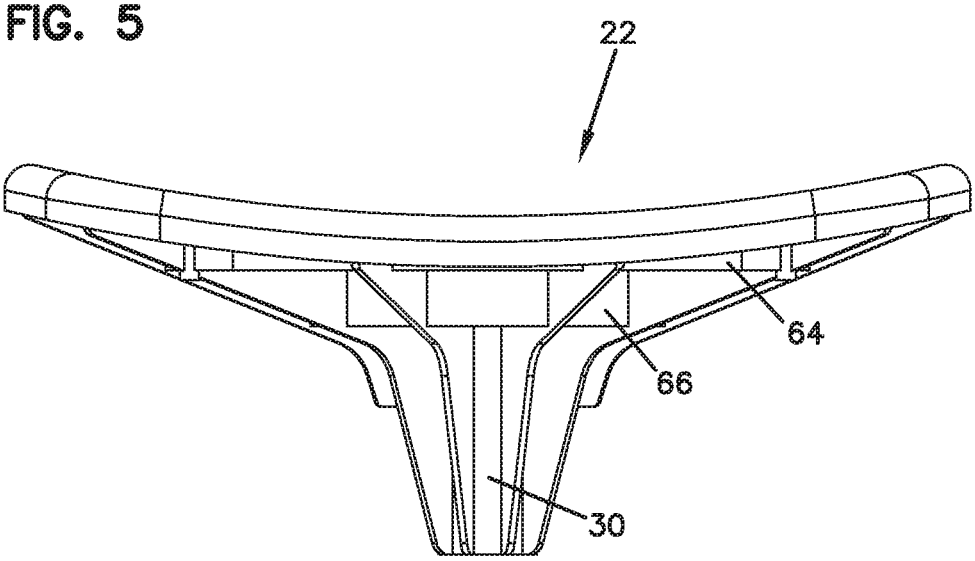
FIG. 5 is a side elevational view of the seat element shown in FIG. 3.
Figure 6:
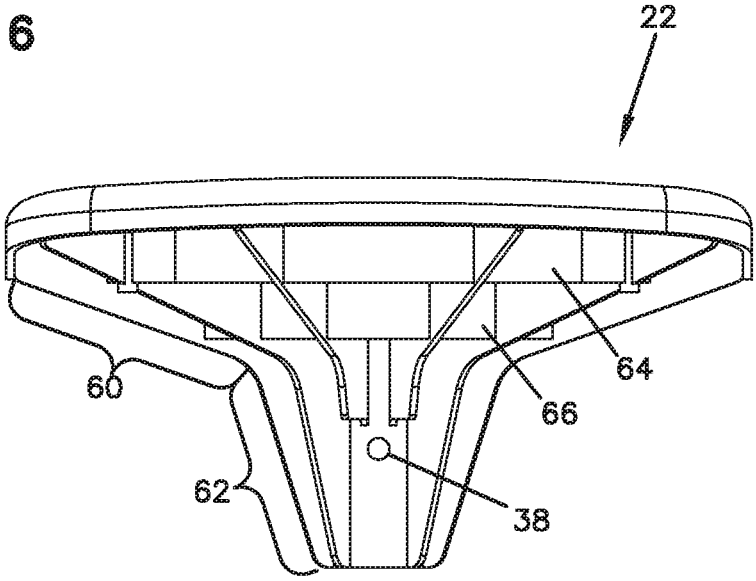
FIG. 6 is an end elevational view of the seat element shown in FIG. 3.
Figure 7:
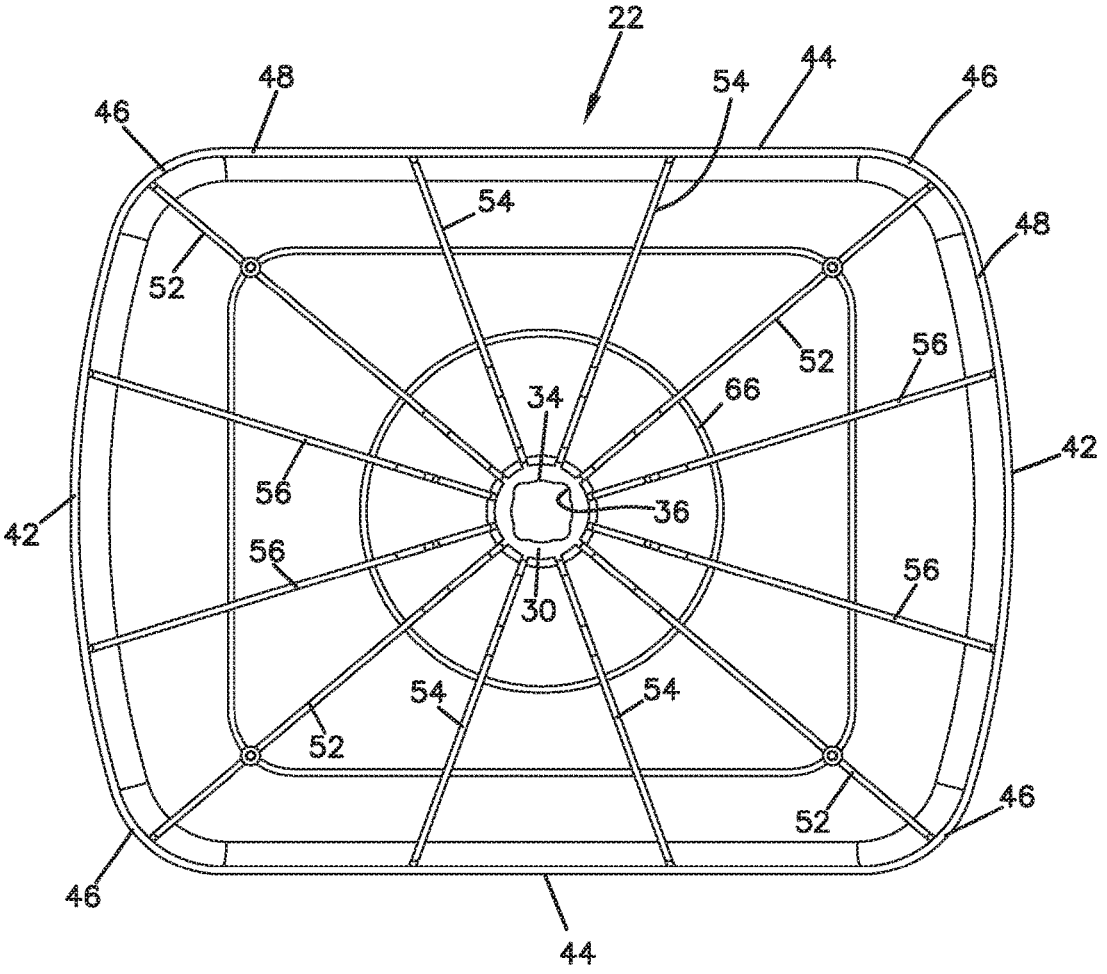
FIG. 7 is a bottom plan view of the seat element shown in FIG. 3.
Figure 8:
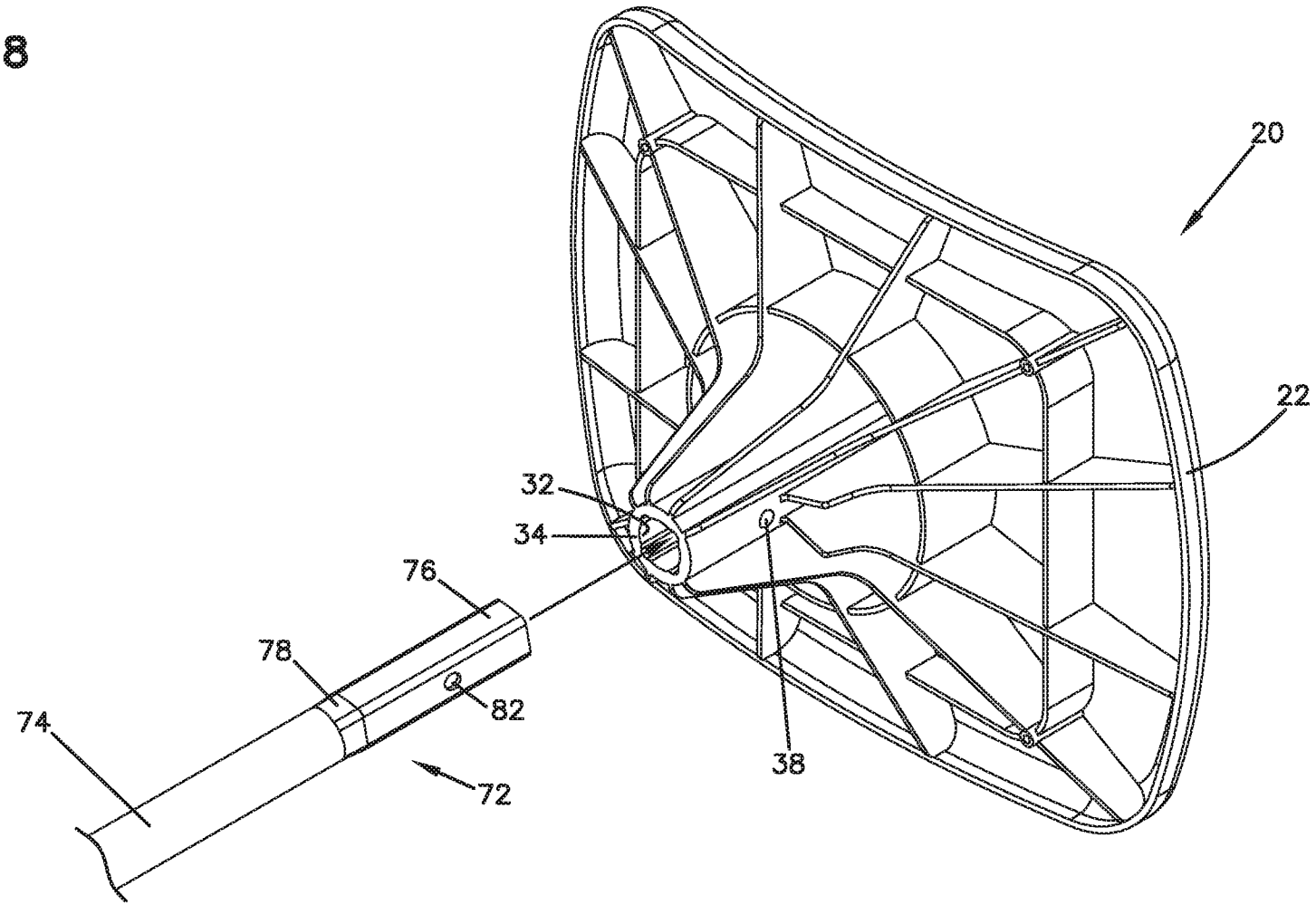
FIG. 8 is a partially exploded bottom perspective view of a second embodiment of a seat assembly for the table and seating apparatus shown in FIG. 1.

Referring to FIGS. 5, 6 and 7, the underside of the seat element (22) includes a frame receiving portion (30). The frame receiving portion (30) defines a central cavity (32) configured to receive a tubular frame member (70) of the table and seating apparatus. The cavity (32) may include generally rounded sides (34) and may include corner portions (36) configured for receiving a frame (72) as shown in FIG. 8. In the embodiment shown in FIG. 8, the frame member (72) includes a circular first portion (74), a non-circular cross section (76) and a transition section (78). The cavity (32) includes corner portions that engage the non-circular cross section portion (76) and prevent relative rotation between the frame member (72) and the seat element (22). The frame receiving portion (30) also includes an orifice (38) configured for receiving a bolt or other retainer. The bolt extends through an orifice (82) in the round tubular frame (70) or the frames (72). Moreover, the cavity (32) may configured to receive conventional tubular frame members (80), as shown in FIG. 2, with the cavity (32) having generally rounded sides (34) engaging the round outer surface of the tubular frame member (80). The generally rounded sides (34) engage the round outer surface of the frame member (80). The orifice (38) aligns with the orifice (82) in the frame to receive a mounting bolt.

Referring to FIGS. 2 and 5-7, the underside of the seat (22) has radial ribs (50) extending generally radially outward from the frame receiving portion (30) out to the lip (48). First radial ribs (52) extend from the frame receiving portion (30) outward to the corners (46). Second radial ribs (54) extend radially outward from the frame receiving portion (30) to the sides (44). Third radial ribs (56) extend outward from the frame receiving portion (30) to the ends (42). However, for the ribs proximate the orifice (38), a shorter form of the ribs (58) extend outward from the frame receiving portion (30) to the ends (42). The ribs (58) also extend downward to a lesser extent than the radial ribs (56) to provide access for the bolt and the orifice (38). It can be appreciated that each of the radial ribs (52, 54 and 56) increase in height generally from the lip (48) to the center frame receiving portion (30). The radial ribs (52, 54, 56 and 58) generally all have a height that is substantially equal to the height of the lip (48) at an outermost section. Moreover, the radial ribs (52, 54 and 56) all generally extend downward at an inner end to the bottom of the frame receiving portion (30) at their inner ends. The radial ribs (52, 54, 56 and 58) each have a first section (60) that generally increases in height from the lip inward at a first angle. A second section (62) has a height that increases at a second angle greater than the first angle from the inner most end of the first portion (60) to the frame receiving portion (30).

In addition to the radial ribs (50), the seat (22) includes a rectangular rib (64). The rectangular rib (64) is spaced apart and inward from the lip (48) and generally parallel to the end (42) and the sides (44). The rectangular rib (64) intersects with the radial ribs and includes corners that intersect with the first radial ribs (52). The rectangular rib (64) has a top portion engaging the underside of the concave upper surface (40) of the seat (22). The lower edge of the rectangular rib (64) is in a horizontal plane.

A circular rib (66) is spaced apart and inward from the rectangular rib (64). The circular rib (66) is therefore intermediate the frame receiving portion (30) and the rectangular rib (64). The circular rib (66) has a height greater than the rectangular rib (64) and extends downward a greater degree than the rectangular rib (64). The seat (22) is configured with height of the supporting structures generally increasing from the outer edge to the center. The center portion (30) has a greater height than the circular rib (66), which has a greater height than the rectangular rib (64), which has a height greater than the lip (48). The circular rib (66) is intersected by the radial ribs (50) and has bottom edge generally even with the bottom edge of the radial ribs (50) at the point of intersection. The lower edge of the circular rib (66) is also in a horizontal plane that is below the horizontal plane of the lower edge of the rectangular rib (64).

It can be appreciated that the seating assembly (20) of the present invention provides for a lightweight more comfortable seat than is provided by the prior art. Moreover, the seat (22) can be easily adapted to conventional seating systems and can replace round stool type seats. Retrofitting easily takes place by simply unbolting the old stool and attaching the seat (22). Moreover, the present invention provides for a simple, durable, lightweight, easily molded and inexpensive monolithic seat (22). The seat (22) includes a frame receiving portion that can accept both conventional round tubular elements as well as frames having a portion with a non-circular cross section. It can be appreciated that the prior art neither teaches nor suggests such a seating system or seats (20) providing all of these features and advantages.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A stool seat assembly, comprising:

a vertical frame element;

a monolithic seat element, comprising:

a seat portion having a substantially rectangular periphery including opposed end portions and opposed side portions with rounded corner portions abutting the end portions and the side portions; the seat portion having a concave upper surface with a center portion lower than the end portions, the seat portion being symmetrical between the opposed end portions and the opposed side portions and symmetrical between the opposed side portions and the opposed end portions, the seat portion having a length between the end portions greater than a depth between the side portions;

the upper surface being entirely free of a depression and having edges at the side portions allowing fluids to run off the seat portion and prevent pooling of fluids anywhere on the upper surface;

a center receiving portion projecting from an underside of the seat portion; the vertical frame element inserting into the center receiving portion;

a plurality of radial ribs extending from the center receiving portion to a periphery of the seat portion.

2. A stool seat assembly according to claim 1, wherein the radial ribs increase in height from the periphery of the seat portion toward the center receiving portion.

3. A stool seat assembly according to claim 1, wherein the radial ribs have a first section increasing in height from the periphery of the seat portion toward the center receiving portion at a first angle, and wherein the radial ribs have a second section increasing in height from the first section to the center receiving portion at a second angle greater than the first angle.

4. A stool seat assembly according to claim 1, further comprising a lip extending downward around a periphery of the seat portion.

5. A stool seat assembly according to claim 4, wherein the radial ribs extend from the lip radially inward.

6. A stool seat assembly according to claim 5, further comprising a rectangular rib support spaced apart inwardly from the lip, the rectangular rib support extending downwardly from an underside of the seat portion and intersecting the radial ribs.

7. A stool seat assembly according to claim 6, further comprising a circular rib support spaced apart inwardly from the rectangular rib support, the circular rib support extending downwardly from an underside of the seat portion and intersecting the radial ribs.

8. A stool seat assembly according to claim 4, further comprising a rectangular rib support spaced apart inwardly from the lip, the rectangular rib support extending downwardly from an underside of the seat portion and intersecting the radial ribs.

9. A stool seat assembly according to claim 8, further comprising a circular rib support spaced apart inwardly from the rectangular rib support, the circular rib support extending downwardly from an underside of the seat portion and intersecting the radial ribs.

10. A stool seat assembly according to claim 1, wherein the frame member comprises a tubular frame member.

11. A stool seat assembly according to claim 1, wherein the receiving portion comprises a complementary cavity configured for receiving the tubular frame member.

12. A stool seat assembly according to claim 1, wherein the seat portion has a length between the end portions greater than a width between the side portions.

13. A stool seat assembly according to claim 1, wherein the frame member comprises a tubular frame member with a first portion having a circular cross-section and a second portion having a non-circular cross-section; and wherein the receiving portion comprises a cavity complementary to a non-circular cross-section of the tubular frame member.

14. A table and seating apparatus, comprising:

a table;

a frame including a vertical frame element;

a monolithic seat element, comprising:

a seat portion having a substantially rectangular periphery including opposed end portions and opposed side portions with rounded corner portions abutting the end portions and the side portions; the seat portion having a concave upper surface with a center portion lower than the end portions, the seat portion being symmetrical between the opposed end portions and the opposed side portions and symmetrical between the opposed side portions and the opposed end portions, the seat portion having a length between the end portions greater than a depth between the side portions, the upper surface being completely free of a depression and having edges at the side portions allowing fluids to run off the seat portion and prevent pooling of fluids anywhere on the upper surface;

a center receiving portion projecting from an underside of the seat portion; the vertical frame element inserting into the center receiving portion;

a plurality of radial ribs extending from the center receiving portion to a periphery of the seat portion.

15. A table and seating apparatus according to claim 14, the upper surface having a generally rounded transition to a downward extending lip extending around the periphery of the seat.

16. A table and seating apparatus according to claim 14, the upper surface of the seat portion having a substantially constant curvature intermediate the end portions.

17. A monolithic seat element, comprising:

a seat portion having a substantially rectangular periphery including opposed end portions and opposed side portions with rounded corner portions abutting the end portions and the side portions; the seat portion having a concave upper surface with a center portion lower than the end portions, the seat portion being symmetrical between the opposed end portions and the opposed side portions and symmetrical between the opposed side portions and the opposed end portions, the seat portion having a length between the end portions greater than a depth between the side portions, the upper surface being completely free of a depression and having edges at the side portions allowing fluids to run off the seat portion and prevent pooling of fluids anywhere on the upper surface;

a center receiving portion projecting from an underside of the seat portion and configured for receiving a vertical frame element;

a plurality of radial ribs extending from the center receiving portion to a periphery of the seat portion.

18. A monolithic seat element according to claim 17, the upper surface having a generally rounded transition to a downward extending lip extending around the periphery of the seat.

19. A monolithic seat element according to claim 17, the upper surface of the seat portion having a substantially constant curvature intermediate the end portions.

20. A stool seat assembly according to claim 1, the upper surface having a generally rounded transition to a downward extending lip extending around the periphery of the seat.

21. A stool seat assembly according to claim 1, the upper surface of the seat portion having a substantially constant curvature intermediate the end portions.

* * * * *